United States Patent [19]

Steimann et al.

[11] 4,089,424

[45] May 16, 1978

[54] DEVICE FOR REMOVING COKE OVEN CHAMBER DOOR

[75] Inventors: Franz Steimann, Gelsenkirchen-Horst; Claus Nagorny, Dinslaken, both of Germany

[73] Assignee: Didier Engineering GmbH, Essen, Germany

[21] Appl. No.: 749,617

[22] Filed: Dec. 10, 1976

[30] Foreign Application Priority Data

Dec. 30, 1975 Germany ..... 2559130

[51] Int. Cl.[2] ..... B66C 13/00; C10B 25/00

[52] U.S. Cl. ..... 212/4; 202/247; 202/248; 214/670

[58] Field of Search ..... 202/248, 247; 212/4; 110/173 R; 214/670

[56] References Cited

U.S. PATENT DOCUMENTS

| | | | |
|---|---|---|---|
| 2,142,447 | 1/1939 | Krall | 212/4 |
| 2,780,366 | 2/1957 | Henseleit | 212/4 |
| 2,797,820 | 7/1957 | Homan | 212/4 |
| 2,807,372 | 9/1957 | Henseleit | 212/4 |
| 3,817,840 | 6/1974 | Stender | 212/4 X |
| 3,848,397 | 4/1976 | Ikio | 202/248 X |

*Primary Examiner*—Morris O. Wolk
*Assistant Examiner*—Arnold Turk
*Attorney, Agent, or Firm*—Wenderoth, Lind & Ponack

[57] ABSTRACT

A support is pivoted to a frame and supports a first hydraulic drive for actuating movable jaws to engage removing latches of a door to be removed. The support also supports a separate second hydraulic drive for locking or unlocking a door locking device of the door. A separate third hydraulic drive is connected between the frame and the support for pivoting the support and a removed door suspended thereby with respect to the frame.

2 Claims, 2 Drawing Figures

DEVICE FOR REMOVING COKE OVEN CHAMBER DOOR

BACKGROUND OF THE INVENTION

The present invention relates to a device for removing the door of a coke outlet opening of a coke oven chamber, in particular of inclined chamber coke ovens, of the type including a locking device provided on the door for pressing the door against a frame surrounding the coke outlet opening, a device for operating the locking device, removing latches provided on the door and capable of being engaged from behind by door removing jaws, and a support pivotable about a pivot provided on the removing device for pivoting the door from the coke outlet opening.

A removing device of this type is disclosed in German Pat. No. 515,446. The support of the known device is pivoted about a fixed pivot by means of a gear drive. During the pivoting of the support toward the door, a guide rod and latch system arranged on the support, through projections provided on a plate that is carried by the guide rod and latch system, opens the latches on the door and engages hooks on the door. This device is associated with the disadvantage of forced coupling between the pivoting, removing and unlocking operations, which necessitates a very precise dimensioning and alignment of the device. Moreover, the contact pressure of the door on the frame cannot be adjusted, and this is a further disadvantage.

German Pat. No. 567,669 discloses a removing device wherein, in the closed position, the door is pressed and held against the door frame by its own weight, as bolts which are fixed to the door are suspended from hooks on the oven wall. During the opening operation, the removing device first of all lifts the door by means of hooks suspended from a chain. Then the entire door removing device and the suspended door is removed from the opening, either in the direction of the chamber axis or perpendicularly thereto. This device is complex in structure, it can be moved only slowly due to its relatively large mass, and the contact pressure of the door against the door frame is likewise not adjustable. The mere utilization of the weight of the door itself is not always sufficient to secure the desired tight contact between the door and the door frame, due to the considerable amount of dirt which may be present on the door and the door frame, including the locking hooks.

Further, in the use of ovens, in particular inclined chamber ovens, it is frequently required to control or regulate the emptying of the chamber, for example, if the coke is to be delivered to a conveyor belt.

SUMMARY OF THE INVENTION

The object of the present invention accordingly is to provide a door removing device which reliably guarantees a perfectly tight closure by the application of adjustable contact pressure of the door against the door frame, a secure engagement of the removing latches from behind by the door removing jaws, and a controllable or regulated pivoting of the door from the emptying cross-section of the coke outlet opening independently of the locking and attachment operations.

This object is achieved according to the present invention by the provision of three, preferably hydraulic, drives that are independent of each other. One of the drives displaces the door removing jaws in up and down directions, so that the jaws engage the removing latches of the door from behind or release such latches. Another of the drives unlocks or locks the door locking device of the door. The remaining of the drives pivots the support together with the suspended door in controlled manner about a pivot.

By separating control of the three displacement operations, the removing device of the invention provides for a very reliable yet flexible operation with a very simple structure.

The removing device is preferably displaceably suspended along rails that extend perpendicular to the oven wall. This provides the possibility of bringing the device to a desired distance in front of the oven wall, and thus there is achieved a further variable for controlling the chamber emptying operation.

The removing device can also be displaceably suspended along rails extending prallel to a block of ovens, so that the device can be employed on all the chambers of an oven block.

BRIEF DESCRIPTION OF THE DRAWINGS

Further objects, features and advantages of the present invention will be apparent from the following description of an exemplified embodiment thereof, made with reference to the attached drawings, wherein.

DETAILED DESCRIPTION OF THE INVENTION

Figure 1:
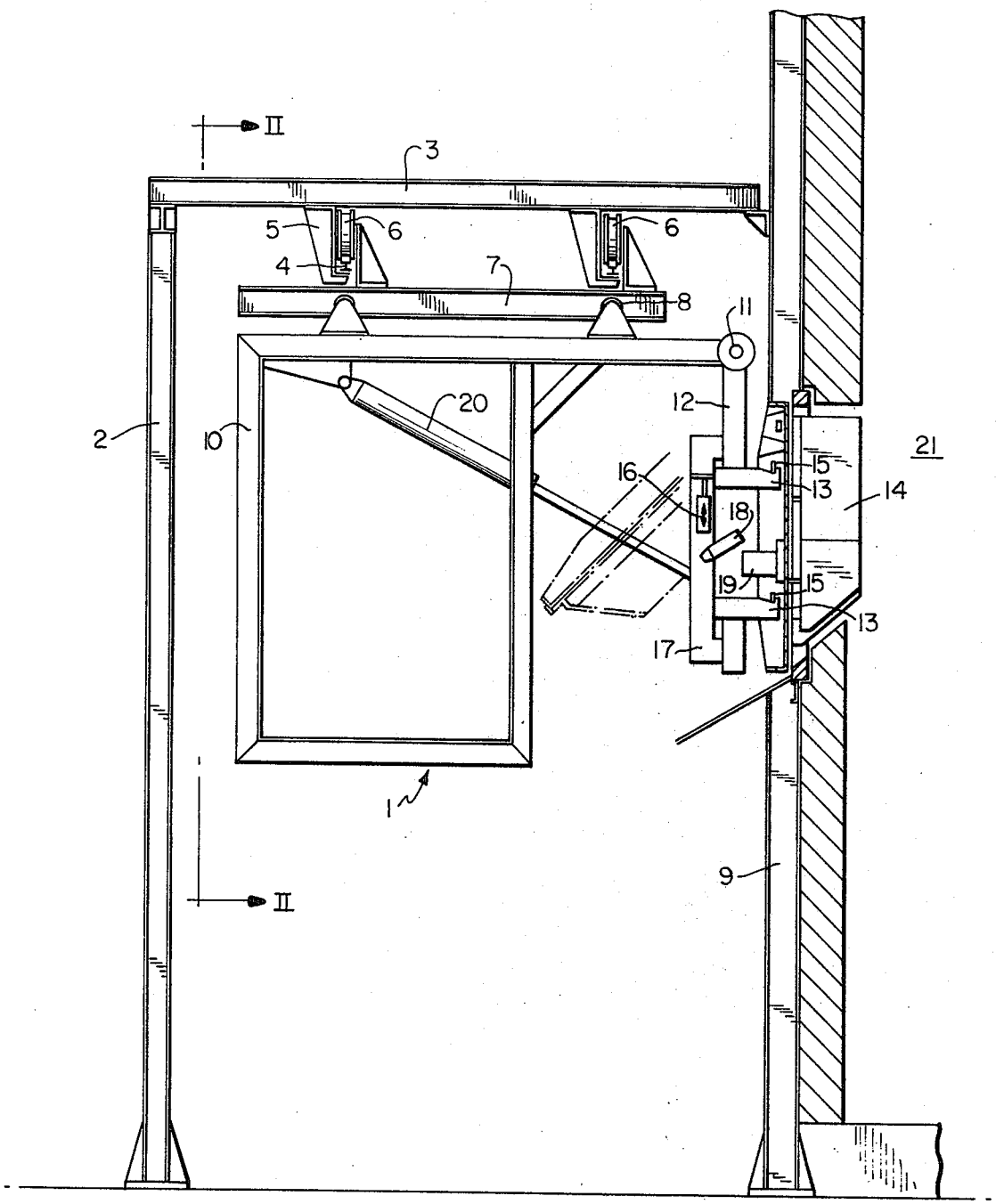
FIG. 1 is a partially schematic and partially sectional side view of a door removing device according to the present invention.
Figure 2:
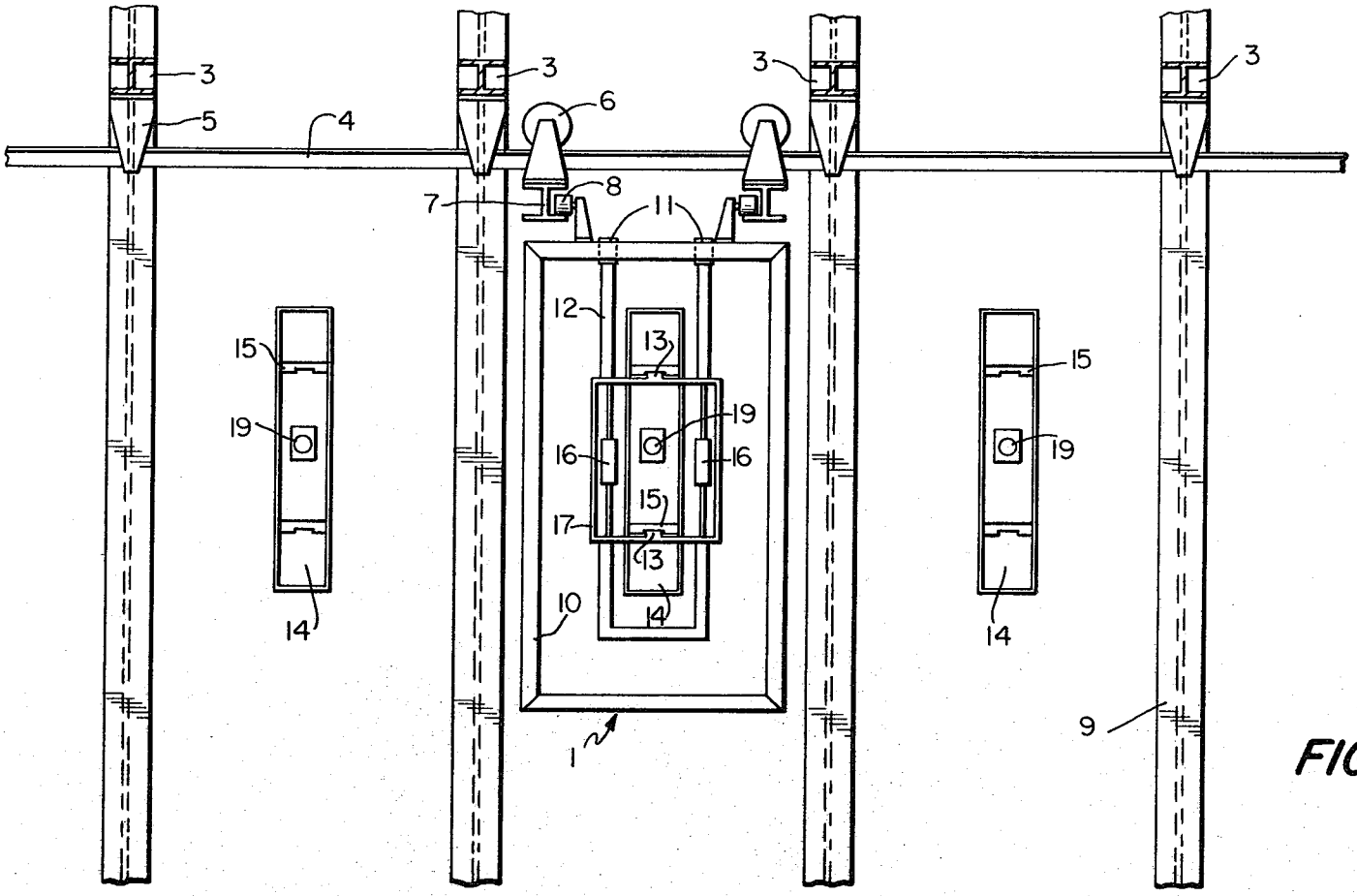
FIG. 2 is a partially schematic front view of the device taken along line II—II of FIG. 1.

A supporting frame structure including vertical supports 2 and horizontal supports 3 is arranged on the coke removal side of an inclined chamber coke oven having therein at least one, and preferably several inclined chambers 21. Horizontal supports 3 are fixed at first ends thereof to anchor posts 9 of the inclined chamber coke oven and at second ends thereof to supports 2. Brackets 5 are attached to horizontal supports 3 and support rails 4.

A door removing device 1 includes a frame 10 which can be displaced along rails 4 parallel to the coke oven block by means of a traverse member 7 in the form of rails extending perpendicularly to the chamber wall and sets of wheels 6 which are attached to traverse 7 and which ride on rails 4. Frame 10 can be displaced along traverse 7 toward and away from the chamber by means of track wheels 8 which are attached to frame 10 and which ride on the rails of traverse 7.

A door support 17 is pivoted by means of an arm 12 around a pivot 11, which is provided on frame 10 and which extends in a direction parallel with the chamber wall. On support 17 there is situated a hydraulic drive 18 (shown schematically in FIG. 1) which engages in a force-locking manner with a locking device 19 of a door 14, in order to unlock or lock the door. Locking device 19 is conventional and thus is shown only schematically in the drawings. Other hydraulic drives 16 are provided on support 17 to move door removing jaws 13, mounted on support 17, behind and beneath removing latches 15 provided on door 14. The controlled or regulated pivoting of support 17 about pivot 11 is effected by means of a further hydraulic drive 20 which is hinged at a first end thereof to support 17 and at a second end thereof to frame 10.

In order to empty an inclined chamber of the coke oven, door removing device 1 is driven along rails 4 along the coke oven block to a position in front of the particular chamber 21 to be emptied. Removing device 1 is then displaced along the rails of traverse 7 by means of rollers 8 to a satisfactory distance in front of the chamber 21. Door removing jaws 13 are then shifted behind removing latches 15 of door 14 by means of hydraulic drives 16. The locking device 19 can then be unlocked by means of hydraulic drive 18, since removing latches 15 of door 14 are safely supported on and held by door removing jaws 13. Door 14 and door removing device 1 including support 17 then form a unit. Support 17 carrying suspended door 14 is then pivoted about pivot 11 in a controllable manner by means of hydraulic drive 20. The amount of outflow or degree of removal of coke from chamber 21 can be precisely regulated with hydraulic drive 20 by pivoting the door forward or backward toward or away from the chamber.

After the chamber emptying operation is completed, door 14 is brought by support 17 of device 1 to an end position or location so that the sealing edges of the chamber door can be cleaned by means of a cleaning device. It is also possible at such time to move a cleaning device to a position in front of the door frame to clean the door frame and remove deposits and incrustations therefrom. With the door removing device 1 in such end position or location, it is also possible to transport chamber door 14 to a repair shop located outside the coke oven block.

In order to close chamber 21, drives 16, 18 and 20 are operated in reverse direction from that described above with reference to the opening operation. By means of hydraulic drive 18 it is particularly possible to set the contact pressure of door 14 against the door frame. After door removing jaws 13 are removed from removing latches 15 by means of drives 16, the door removing device 1 can be shifted away from the chamber by means of rollers or wheels 8 and then transported by means of wheels or rollers 6 to the next chamber to be serviced.

Various modifications may be made to the above specifically described structural arrangement without departing from the scope of the invention.

What is claimed is:

1. A device for removing in a block of ovens chamber doors of the type including a locking mechanism pressing the door against a door frame surrounding an outlet opening of an oven chamber and including removing latches, said device comprising:

a supporting structure adapted to be fixedly positioned adjacent a block of oven chambers, said supporting structure having thereon rails extending substantially parallel to the oven block;

a traverse member suspended from said rails and movable along said rails in a direction substantially parallel to the oven block;

a frame suspended from said traverse member and movable therealong toward and away from each oven chamber in a direction substantially perpendicular to that of the traverse member;

a door support pivotally suspended from said frame about a horizontal axis extending substantially parallel to said oven block;

door removing jaws displaceably mounted on said door support;

first drive means, mounted on said door support, for moving said jaws into engaging contact with removing latches of a chamber door of the chamber oven;

second drive means, mounted on said door support, for locking or unlocking a door locking device of said chamber door, said second drive means being operable independently of said first drive means; and third drive means, mounted between said frame and said door support, for pivoting said door support and a removed door supported thereby about said horizontal axis toward and away from the chamber opening, said third drive means being operable independently of said first and second drive means.

2. A device as claimed in claim 1, wherein said three drive means comprise hydraulic drives.

* * * * *